US007332994B2

(12) United States Patent
Hakes et al.

(10) Patent No.: US 7,332,994 B2
(45) Date of Patent: Feb. 19, 2008

(54) APPARATUS FOR POSITIVE INDICATION OF FUSE LATCH OPERATION IN ELECTRICAL SWITCHGEAR

(76) Inventors: Gary Hakes, 6389 Rich Valley Rd., Bristol, VA (US) 24202; Dale Langston, 19382 Hunt Club Rd., Abingdon, VA (US) 24211

( * ) Notice: Subject to any disclaimer, the term of this patent is extended or adjusted under 35 U.S.C. 154(b) by 319 days.

(21) Appl. No.: 10/928,850

(22) Filed: Aug. 27, 2004

(65) Prior Publication Data

US 2005/0052273 A1 Mar. 10, 2005

Related U.S. Application Data

(60) Provisional application No. 60/500,891, filed on Sep. 5, 2003.

(51) Int. Cl.
*H01H 39/00* (2006.01)
*H01H 37/76* (2006.01)

(52) U.S. Cl. ..... 337/157; 337/244

(58) Field of Classification Search ..... 361/627–631
See application file for complete search history.

(56) References Cited

U.S. PATENT DOCUMENTS 2,128,145 A * 8/1938 Hermann ..... 337/244
2,955,176 A * 10/1960 McCloud ..... 337/157

* cited by examiner

*Primary Examiner*—Lisa Lea-Edmonds
(74) *Attorney, Agent, or Firm*—Smith, Gambrell & Russell LLP

(57) ABSTRACT

An apparatus for indicating the proper seating of a high voltage fuse in its mounting assembly in connection with electrical switchgear utlilizes a spring loaded flag positioned adjacent a latching protrusion for engagement by the latch of the mounting assembly such that the flag is moved from an obscured position to an visible position only when the latch is in its affirmatively locked position.

4 Claims, 1 Drawing Sheet

APPARATUS FOR POSITIVE INDICATION OF FUSE LATCH OPERATION IN ELECTRICAL SWITCHGEAR

BACKGROUND OF THE INVENTION

This patent application is based on U.S. provisional patent application No. 60/500,891, that was filed on Sep. 5, 2003.

The present invention relates to the field of electrical switchgear and more particularly to the field of switchgear fuses. In even greater particularity the present invention relates to an indicator mounted on a fuse housing body to give a visual indication that the fuse has been properly latched into the fuse mounting structure.

Fuses for electrical switchgear are typically attached to fuse handling hardware including an interrupter body at a first end and a pull ring assembly a the opposite end. The hardware is configured to positively support the fuse on a fuse mounting assembly which is often times pivotally mounted on a door or carrier such as within the switchgear housing. The interrupter body is generally configured to engage a latching mechanism which is part of the fuse mounting assembly. A set of "ears" are formed on the outside of the interrupter body and have a cam like surface inclined away from the axis of the fuse and body. The fuse and interrupter body are generally pivotally mounted within the mounting assembly such that as the interrupter body pivots to move the fuse into its proper position a spring loaded latch moves up the cam surface until the surface abruptly ends at a shoulder extending outwardly from the body, whereupon the latch is urged and against the interrupter body and helps to secure the fuse in the mounting assembly such that the entire assembly may be rotated into position to complete the electrical connection. The manipulation of the fuse is often accomplished with hotsticks or insulated gear as a safety precaution.

Occasionally the fuse and interrupter are not actually moved to a latched position in as much as the pull ring end of the fuse also engages an electrical contact and some times the fuse only appears to be latched in the mounting assembly due to frictional resistance of the latch or at the pull ring end. Improper seating of the fuse can lead to fuse failure and failure of the phase of the switchgear associated with the fuse. Accordingly, a need exists for an indicator that will visibly identify the fuse as being properly seated in the fuse mounting assembly.

SUMMARY OF THE PRESENT INVENTION

It is the object of this invention to improve the reliability of fuses used in electrical switchgear.

Another object of the present invention is to give a person installing a fuse in electrical switchgear an indication that the fuse is affirmatively latched into place.

Yet another object of the invention is to provide a visual cue that the latching mechanism has engaged when a switchgear fuse is installed.

BRIEF DESCRIPTION OF THE DRAWINGS

Apparatus embodying features of the present invention are depicted in the accompanying drawings which form a portion of this disclosure and where in:

FIG. 1 is a perspective view showing a fuse holder body with a visual indicator mounted there to.

DESCRIPTION OF THE PREFERRED EMBODIMENT

Figure 1:
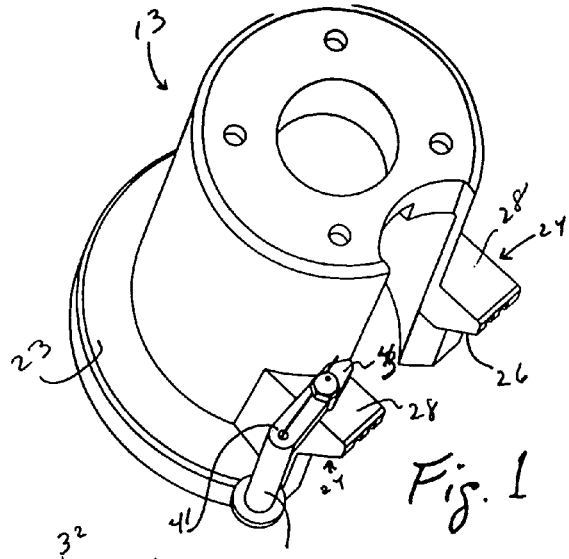
Figure 2:
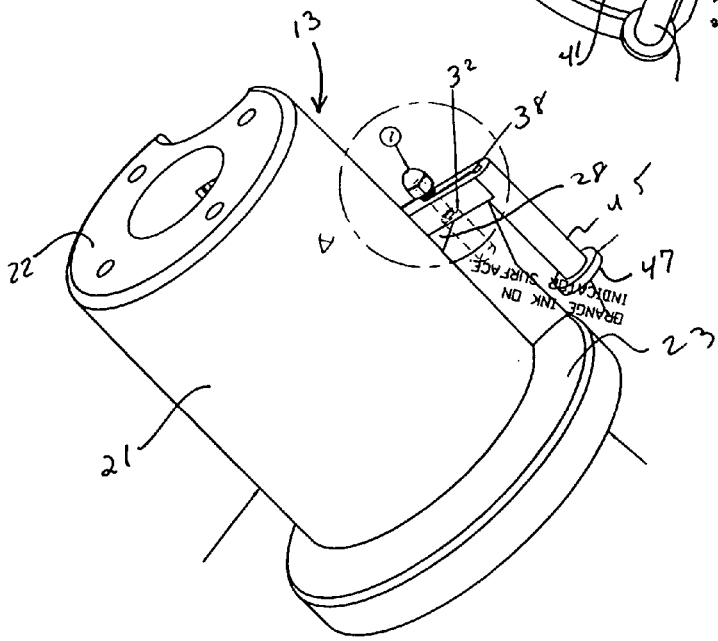
FIG. 2 is a second perspective view of a fuse holder body with a visual indicator mounted thereto.
Figure 3:
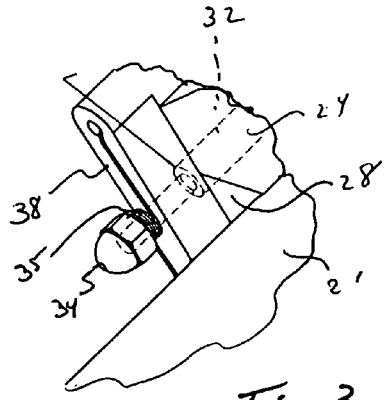
FIG. 3 is a detailed view of the indicator mounted to the fuse holder body.

Referring to the drawings for a clearer understanding of the invention, it may be seen that the present invention finds its application in conjunction with a fuse of the type used in high-voltage switchgear. As is well known in the art the fuse is a replaceable unit which is mated to a reusable end piece 12 and a reusable fuse holder body 13. The end-piece 12 provides electrical connection between the fuse and a mounting bracket connected to the high-voltage circuit. The fuse holder 13, is the primary mounting structure for securing the fuse in a fuse mounting bracket as a part of a fuse mounting assembly. The fuse mounting assembly is preferentially on a hinged door that allows the mounting assembly and fuse to be moved as a unit into and out of engagement with the protected electrical circuit.

Fuse holder body 13 is made from a molded polyester and typically includes a body 21 closed at one end 22 and tapped at that end for appropriate electrical connections. The other end is open and receives the fuse therein. A radially extending annular flange 23 circumscribes the open end, however, one side of the body 21 is slotted from the open end to near the closed end 22. Adjacent the slot are a pair of protrusions 24 formed to cooperatively engage a latch 25 included in mounting assembly. The protrusions 24 form an inclined face 26 which flares outwardly from the body 21 away from flange 23 and terminates in a face 28, which is normal to body 21. In practice the resiliently mounted latch 25 of the fuse mounting assembly is cammed outwardly by relative motion between itself and inclined surface 26 until the latch 25 passes over protrusion 24 to latch behind normal face 28. The present invention is intended to provide a visible indication that such latching actually occurs and that the latch 25 is not left engaging only inclined face 26.

An aperture is formed in normal face 28 and a thermo-bonded threaded insert 32 is affixed into the aperture. A threaded fastner 34 with a torsion spring 36 coaxially placed thereon passes through a link 38 and threadedly engaged in insert 32. Link 38 is thus mounted for rotation about an axis parallel to the central axis of fuse holder body 13 and has a first end 41 which extends beyond the normal face 28 of protrusion 24. A second end 43 of link 38 is shorter as measured from the pivot axis and moves in an arc across normal face 28. Spring 36 biases the link 38 such that first end 41 is biased toward the body 21 of fuse holder body 13. Accordingly first end 41 is behind flange 23 in its biased position. Preferentially first end 41 will carry an extension 45 which is perpendicular to link 38 and has a colored face or flag 47 having a dimension such that the flag is obscured by flange 23 when link 38 is biased toward the body 21 by spring 36.

In operation when the latch is cammed over protrusion 24 and falls behind normal face 28, it displaces second end 43 against the bias of the face 28 such that first end 41 is pivoted away from body 21 and the flag 47 is moved outwardly from body 21 beyond flange 23 such that it becomes visible by the worker installing the fuse.

In an alternative embodiment, the presence of flange 23 is irrelevant, rather a fan shaped indicator is pivotally attached to normal surface 36 near the apex of indicator. Indicator has an outer edge and an inner edge which are separated by an internal arc of nearly 90°. Spring 35 biases the indicator such that inner edge is urged toward the intersection of normal surface 28 and inclined surface 26, thus outer edge is aligned with or just inside the outer edge of normal surface 28 and therefore. Indicator is the same color as holder 13 over the surfaces thereof other than the face abutting and adjacent normal surface 28 which is distinctly colored to serve as a flag. Thus when the inner edge is biased toward the inclined face and the outer edge in inward of the edge of normal surface 28, there is no contrast of color visible. When latch 25 is properly seated behind normal surface 28, it abuts inner edge and urges it away from the junction of the normal and inclined surfaces, thereby causing outer edge to extend beyond the lateral edge of normal surface 28 and exposing distinctively colored flag to be exposed to the view of the worker installing the fuse. As may be seen, this embodiment may be used on fuse holders where flange 23 is too narrow or not present or does not provide adequate obscuration of flag 47.

The invention has been described with reference to two embodiments by way of illustration and not limitation, rather the invention is limited only by the scope of the appended claims.

What is claimed is:

1. In a fuse holder body for use with a fuse mounting assembly and a latch for securing said fuse holder body in said fuse mounting assembly, the improvement comprising: an indicator for visibly indicating positive engagement of said latch with said fuse holder body when said fuse holder body is properly seated in said fuse mounting assembly wherein said fuse holder body includes at least one protrusion for engagement with said latch, said protrusion including an inclined surface flaring away from said fuse holder body and a surface normal to said fuse body and wherein said indicator comprises: a flag having a distinctive coloration, mounted to said protrusion and movable between an obscured position adjacent said fuse holder body and a visible position extended from said fuse holder body and an annular flange extending radially from said body at one end thereof such that said indicator is obscured when said fuse holder body is not positively engaged in said fuse holder assembly.

2. In a fuse holder body for use with a fuse mounting assembly and a latch for securing said fuse holder body in said fuse mounting assembly, the improvement comprising: an indicator for visibly indicating positive engagement of said latch with said fuse holder body when said fuse holder body is properly seated in said fuse mounting assembly wherein said fuse holder body includes an annular flange extending radially from said body at one end thereof such that said indicator is obscured when said fuse holder is not positively engaged in said fuse holder assembly.

3. The improvement as defined in claim 2 wherein said link is pivotally mounted to said normal surface of said protrusion for rotation about an axis parallel to a central axis of said fuse holder body, said link having a first end extending beyond said protrusion and carrying a flag and a second end extending along said normal surface for engagement by said latch, and further comprising a resilient member mounted between said link and said protrusion such that said second end is urged towards said fuse holder body and behind said flange.

4. A fuse mounting assembly comprising: a fuse holder body including an annular flange extending radially from said fuse holder body at one end thereof and an indicator mounted to said fuse holder body such that said indicator is displaced a by proper engagement of said fuse holder body in said fuse mounting assembly, whereby said link is moved to a visible position.

* * * * *